US006677282B2

(12) United States Patent
Lange et al.

(10) Patent No.: US 6,677,282 B2
(45) Date of Patent: Jan. 13, 2004

(54) DISPERSANT-VISCOSITY IMPROVERS FOR LUBRICATING OIL AND FUELS

(75) Inventors: Richard M. Lange, Euclid, OH (US); Stuart L. Bartley, Wicklcliffe, OH (US); Daniel M. Vargo, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/311,511

(22) PCT Filed: Jun. 21, 2001

(86) PCT No.: PCT/US01/19880

§ 371 (c)(1),
(2), (4) Date: Dec. 16, 2002

(87) PCT Pub. No.: WO01/98440

PCT Pub. Date: Feb. 27, 2001

(65) Prior Publication Data

US 2003/0207773 A1 Nov. 6, 2003

(51) Int. Cl.[7] ..... C10M 145/00; C10L 1/18

(52) U.S. Cl. ..... 508/452; 508/454; 508/455; 44/386

(58) Field of Search ..... 508/452, 454, 508/455; 44/386; 525/55, 374, 386

(56) References Cited

U.S. PATENT DOCUMENTS

| | | | |
|---|---|---|---|
| 2,212,506 A | 8/1940 | Bachman et al. | 260/485 |
| 2,782,228 A | 2/1957 | Dazzi et al. | 260/485 |
| 4,005,993 A | 2/1977 | Niebylski et al. | 44/68 |
| 5,919,275 A | 7/1999 | Oppenländer et al. | 44/334 |

FOREIGN PATENT DOCUMENTS

| | | |
|---|---|---|
| DE | 4412489 | 10/1995 |
| EP | 005 063 | 10/1979 |
| EP | 759 435 | 2/1997 |
| EP | 759 444 | 2/1997 |
| EP | 882 782 | 12/1998 |
| EP | 902 023 | 3/1999 |

*Primary Examiner*—Jacqueline V. Howard
(74) *Attorney, Agent, or Firm*—David M. Shold; Michael F. Esposito

(57) ABSTRACT

Hydrocarbyl substituted carboxylic compositions and derivatives thereof useful as dispersant/viscosity improvers for lubricating oil and fuel compositions. Carboxylic compositions are derived from (A) a hydrocarbon polymer having $M_n$ ranging from about 20,000 to about 500,000, and (B) an α,β-unsaturated carboxylic compound prepared by reacting (1) an active methylene compound of the formula (I), and (2) a carbonyl compound of the general formula (II), wherein $R^a$ is H or hydrocarbyl and $R^b$ is a member of the group consisting of H, hydrocarbyl and (III), wherein each R' is independently R or OR and each R is, independently, H or a hydrocarbyl group; and lower alkyl acetals, ketals, hemiacetals and hemiketals of the carbonyl compound (2). Carboxylic derivative compositions are obtained by reacting the carboxylic compositions with a reactant selected from the group consisting of (a) amines characterized by the presence within their structure of at least one condensable H—N< group, (b) alcohols, (c) reactive metal or reactive metal compounds, and (d) a combination of two or more of any of (a) through (c), the components of (d) being reacted with the carboxylic composition simultaneously or sequentially, in any order.

13 Claims, No Drawings

DISPERSANT-VISCOSITY IMPROVERS FOR LUBRICATING OIL AND FUELS

This application is a 371 of PCT/US01/19880 F Jun. 21, 2001.

FIELD OF THE INVENTION

This invention relates to hydrocarbyl substituted carboxylic compositions and derivatives prepared therefrom. The carboxylic compositions and derivatives are useful as dispersant/viscosity improvers for lubricating oil and fuel compositions.

BACKGROUND OF THE INVENTION

The viscosity of lubricating oils, particularly the viscosity of mineral oil based lubricating oils, is generally dependent upon temperature. As the temperature of the oil is increased, the viscosity usually decreases.

The function of a viscosity improver is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Numerous types of additives are used to improve lubricating oil and fuel compositions. Such additives include, but are not limited to dispersants and detergents of the ashless and ash-containing variety, oxidation inhibitors, anti-wear additives, friction modifiers, and the like. Such materials are well known in the art and are described in many publications, for example, Smalheer, et al, "lubricant Additives", Lezius-Hiles Co., Cleveland, Ohio, USA (1967); M. W. Ranney, Ed., "Lubricant Additives", Noyes Data Corp., Park Ridge, N.J. USA (1973); M. J. Satriana, Ed.; "Synthetic Oils and Lubricant Additives, Advances since 1977", Noyes Data Corp., Park Ridge N.J. USA (1982), W. C. Gergel, "Lubricant Additive Chemistry", Publication 694-320-65R1 of the Lubrizol Corp., Wickliffe, Ohio, USA (1994); and W. C. Gergel et al, "Lubrication Theory and Practice" Publication 794-320-59R3 of the Lubrizol Corp., Wickliffe, Ohio, USA (1994); and in numerous United States patents, for example Chamberlin, III, U.S. Pat. No. 4,326,972, Ripple et al, U.S. Pat. No. 4,904,401, and Ripple et al, U.S. Pat. No. 4,981,602.

Dispersants are well-known in the lubricating art. Dispersants are employed in lubricants to keep impurities, particularly those formed during operation of mechanical devices such as internal combustion engines, automatic transmissions, etc. in suspension rather than allowing them to deposit as sludge or other deposits on the surfaces of lubricated parts.

Conventional dispersants are poor contributors to improving high temperature, e.g., 100° C., viscosity. Mixtures of conventional dispersants with polymeric viscosity improvers are often used but such combinations are costly and may adversely affect low temperature viscometric performance.

Multifunctional additives that provide both viscosity improving properties and dispersant properties are likewise known in the art. Such products are described in numerous publications including Dieter Klamann, "Lubricants and Related Products", Verlag Chemie Gmbh (1984), pp. 185–193; C. V. Smalheer and R. K.

Smith, "Lubricant Additives", Lezius-Hiles Co. (1967); M. W. Ranney, "Lubricant Additives", Noyes Data Corp. (1973), pp. 92–145, M. W. Ranney, "Lubricant Additives, Recent Developments", Noyes Data Corp. (1978), pp. 139–164; and M. W. Ranney, "Synthetic Oils and Additives for Lubricants", Noyes Data Corp. (1980), pp. 96–166. Each of these publications is hereby expressly incorporated herein by reference.

Dispersant-viscosity improvers are generally prepared by functionalizing, i.e., adding polar groups, to a hydrocarbon polymer.

Hayashi et al, U.S. Pat. No. 4,670,173 relates to compositions suitable for use as dispersant-viscosity improvers made by reacting an acylating reaction product which is formed by reacting a hydrogenated block copolymer and an alpha,beta olefinically unsaturated reagent in the presence of free-radical initiators, then reacting the acylating product with a primary amine and optionally with a polyamine and a mono-functional acid.

Chung et al, U.S. Pat. No. 5,035,821 relates to viscosity index improver-dispersants comprised of the reaction products of an ethylene copolymer grafted with ethylenically unsaturated carboxylic acid moieties, a polyamine having two or more primary amino groups or polyol and a high functionality long chain hydrocarbyl substituted dicarboxylic acid or anhydride.

Van Zon et al, U.S. Pat. No. 5,049,294, relates to dispersant/VI improvers produced by reacting an alpha,beta-unsaturated carboxylic acid with a selectively hydrogenated star-shaped polymer then reacting the product so formed with a long chain alkane-substituted carboxylic acid and with a $C_1$ to $C_{18}$ amine containing 1 to 8 nitrogen atoms and/or with an alkane polyol having at least two hydroxy groups or with the preformed product thereof.

Bloch et al, U.S. Pat. No. 4,517,104, relates to oil soluble viscosity improving ethylene copolymers reacted or grafted with ethylenically unsaturated carboxylic acid moieties then with polyamines having two or more primary amine groups and a carboxylic acid component or the preformed reaction product thereof.

Gutierrez et al, U.S. Pat. No. 4,632,769, describes oil-soluble viscosity improving ethylene copolymers reacted or grafted with ethylenically unsaturated carboxylic acid moieties and reacted with polyamines having two or more primary amine groups and a $C_{22}$ to $C_{28}$ olefin carboxylic acid component.

Lange, et al, U.S. Pat. No. 4,491,527 relates to ester-heterocycle compositions useful as "lead paint" inhibitors in lubricants. The compositions comprise derivatives of substituted carboxylic acids in which the substituent is a substantially aliphatic, substantially saturated hydrocarbon based radical containing at least about 30 aliphatic carbon atoms; said derivatives being the combination of: (A) at least one ester of said carboxylic acids in which all the alcohol moieties are derived from at least on mono- or polyhydroxyalkane; and (B) at least one heterocyclic condensation product of said substituted carboxylic acids containing at least one heterocyclic moiety which includes a 5- or 6-membered ring which contains at least two ring hetero atoms selected from the group consisting of oxygen, sulfur and nitrogen separated by a single carbon atom, at least one of said hetero atoms being nitrogen, and at least one carboxylic moiety; the carboxylic and heterocyclic moieties either being linked through an ester or amide linkage or being the same moiety in which said single carbon atom separating two ring hetero atoms corresponds to a carbonyl carbon atom of the substituted carboxylic acid.

Lange, et al, U.S. Pat. No. 5,512,192 teach dispersant viscosity improvers for lubricating oil compositions comprising a vinyl substituted aromatic-aliphatic conjugated diene block copolymer grafted with an ethylenically unsaturated carboxylic acid reacted with at least one polyester containing at least one condensable hydroxy group and at least one polyamine having at least one condensable primary or secondary amino group, and optionally, at least one hydrocarbyl substituted carboxylic acid or anhydride.

Lange, U.S. Pat. No. 5,540,851 describes dispersant viscosity improvers for lubricating oil compositions which are the reaction product of (a) an oil soluble ethylene-alpha olefin copolymer wherein the alpha olefin is selected from the group consisting of $C_{3-28}$ alpha olefins, said polymer having a number average molecular weight ranging from about 30,000 to about 300,000 grafted with an ethylenically unsaturated carboxylic acid or functional derivative thereof; with at least one polyester containing at least one condensable hydroxyl group, and at least one polyamine having at least one condensable primary or secondary amino group, and optionally at least one hydrocarbyl substituted carboxylic acid or anhydride.

Each of these patents is hereby expressly incorporated herein by reference. For additional disclosures concerning multi-purpose additives and particularly viscosity improvers and dispersants, the disclosures of the following United States patents are incorporated herein by reference:

| |
|---|
| 2,973,344 |
| 3,278,550 |
| 3,311,558 |
| 3,312,619 |
| 3,326,804 |
| 3,403,011 |
| 3,404,091 |
| 3,445,389 |
| 3,488,049 |
| 3,513,095 |
| 3,563,960 |
| 3,598,738 |
| 3,615,288 |
| 3,637,610 |
| 3,652,239 |
| 3,687,849 |
| 3,799,877 |
| 3,842,010 |
| 3,864,098 |
| 3,864,268 |
| 3,879,304 |
| 4,033,889 |
| 4,051,048 |
| 4,234,435 |

Many such additives are derived from carboxylic reactants, for example, acids, esters, anhydrides, lactones, and others. Specific examples of commonly used carboxylic compounds used as intermediates for preparing lubricating oil additives include high molecular weight hydrocarbyl group substituted carboxylic acids such as succinic acids and anhydrides, aromatic acids, such as salicylic acids, and others. Illustrative carboxylic compounds are described in Lange et al, U.S. Pat. No. 5,512,192, Lange U.S. Pat. Nos. 5,540,851 and 5,811,378 and Hayashi et al U.S. Pat. No. 4,670,173.

Such carboxylic acids are typically prepared by thermally reacting or free radical grafting of carboxylic groups such as maleic anhydride, acrylic compounds, etc. with a high molecular weight hydrocarbon. Reaction rates are relatively low. Attempts to improve the conversion rate by increasing the reaction temperature and/or using super-atmospheric pressure often results in degradation of maleic anhydride to carbon dioxide, water and tar-like solids.

In industry, it is also desirable to have available a wide variety of reactants available to prepare compositions. Materials shortages, costs, etc. contribute to uncertainties in the industry. These uncertainties can be relieved when more than a limited number of types raw materials are available to a manufacturer. The compositions of this invention are prepared employing raw materials that are different from, and are not suggested by, traditionally used raw materials.

SUMMARY OF THE INVENTION

This invention relates to carboxylic compositions and derivatives thereof useful as dispersant viscosity improvers for lubricating oils and fuels. The carboxylic compositions are also useful as intermediates for preparing derivatives for use as dispersant viscosity improvers. Both the carboxylic compositions and the derivatives thereof find utility as dispersant/viscosity improvers for lubricating oil and fuel compositions. Hydrocarbyl group substituted carboxylic compositions are derived from (A) a hydrocarbon polymer having $\overline{M}_n$ ranging from about 20,000 to about 500,000 and (B) an α,β-unsaturated carboxylic compound prepared by reacting (1) an active methylene compound of the formula

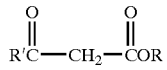

and (2) a carbonyl compound of the general formula

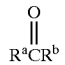

wherein $R^a$ is H or hydrocarbyl and $R^b$ is a member of the group consisting of H, hydrocarbyl and

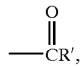

wherein each R' is independently R or OR and each R is, independently, H or a hydrocarbyl group; and lower alkyl acetals, ketals, hemiacetals and hemiketals of the carbonyl compound (2). Carboxylic derivative compositions are obtained by reacting the carboxylic compositions with a reactant selected from the group consisting of (a) amines characterized by the presence within their structure of at least one condensable H—N< group, (b) alcohols, (c) reactive metal or reactive metal compounds, and (d) a combination of two or more of any of (a) through (c), the components of (d) being reacted with the carboxylic composition simultaneously or sequentially, in any order.

DETAILED DESCRIPTION OF THE PREFERRED EMBODIMENTS

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than, carbon present in a chain or ring otherwise composed of carbon atoms.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

It must be noted that as used in this specification and appended claims, the singular forms also include the plural unless the context clearly dictates otherwise. Thus the singular forms "a", "an", and "the" include the plural; for example "an amine" includes mixtures of amines of the same type. As another example the singular form "amine" is intended to include both singular and plural unless the context clearly indicates otherwise.

Hydrocarbon Polymer As used herein, the expression 'polymer' refers to polymers of all types, i.e., homopolymers and copolymers. The term homopolymer refers to polymers derived from essentially one monomeric species; copolymers are defined herein as being derived from 2 or more monomeric species.

The hydrocarbon polymer is an essentially hydrocarbon based polymer, usually one having a number average molecular weight ($\overline{M}_n$) between about 20,000 and about 500,000, often from about 20,000 to about 300,000, frequently from about 40,000 to about 200,000. Molecular weights of the hydrocarbon polymer are determined using well known methods described in the literature. Examples of procedures for determining the molecular weights are gel permeation chromatography (GPC) (also known as size-exclusion chromatography) and vapor phase osmometry (VPO). It is understood that these are average molecular weights. GPC molecular weights are typically accurate within about 5–10%. Even with narrow polydispersity, a polymer with $\overline{M}_n$ of about 20,000 may have some species as low as about 15,000. A polymer with $\overline{M}_w$ about 35,000 and $\overline{M}_n$ about 20,000 may have GPC peaks corresponding to polymer components as low as about 10,000 and as high as 75,000.

These and other procedures are described in numerous publications including:

P. J. Flory, "Principles of Polymer Chemistry", Cornell University Press (1953), Chapter VII, pp. 266–316, "Macromolecules, an Introduction to Polymer Science", F. A. Bovey and F. H. Winslow, Editors, Academic Press (1979), pp. 296–312, and W. W. Yau, J. J. Kirkland and D. D. Bly, "Modem Size Exclusion Liquid Chromatography", John Wiley and Sons, New York, 1979.

Unless otherwise indicated, GPC molecular weights referred to herein are polystyrene equivalent weights, i.e., are molecular weights determined employing polystyrene standards.

A measurement which is complementary to a polymer's molecular weight is the melt index (ASTM D-1238). Polymers of high melt index generally have low molecular weight, and vice versa. The polymers of the present invention preferably have a melt index of up to 20 dg/min., more preferably 0.1 to 10 dg/min.

These publications are hereby incorporated by reference for relevant disclosures contained therein relating to the determination of molecular weight.

When the molecular weight of a polymer is greater than desired, it may be reduced by techniques known in the art. Such techniques include mechanical shearing of the polymer employing masticators, ball mills, roll mills, extruders and the like. Oxidative or thermal shearing or degrading techniques are also useful and are known. Details of numerous procedures for shearing polymers are given in U.S. Pat. No. 5,348,673. which is hereby incorporated herein by reference for relevant disclosures in this regard. Reducing molecular weight also tends to improve the subsequent shear stability of the polymer.

The polymer may contain aliphatic, aromatic or cycloaliphatic components, or mixtures thereof. When the polymer is prepared from the monomers, it may contain substantial amounts of olefinic unsaturation, oftentimes far in excess of that which is desired for this invention. The polymer may be subjected to hydrogenation to reduce the amount of unsaturation to such an extent that the resulting hydrogenated polymer has olefinic unsaturation, based on the total number of carbon to carbon bonds in the polymer, of less than 5%, frequently less than 2%, often no more than 1% olefinic unsaturation.

In one embodiment, the polymer is substantially saturated. By substantially saturated is meant that no more than 5% of the carbon to carbon bonds, often no more than 1% and frequently no more than 0.5% of the carbon to carbon bonds are olefinically unsaturated. Most often, substantially saturated means that the polymer is essentially free of olefinic unsaturation. In the case where the polymer is substantially saturated, the reaction with (B) is conducted employing a free radical initiator. Such processes are described in U.S. Pat. Nos.5,512,192 and 5,540,851 which are incorporated herein by reference.

In another embodiment, the polymer (A) contains olefinic unsaturation and the reaction is conducted thermally, employing the well known "ene" process, optionally in the presence of added chlorine. The use of added chlorine during the reaction often facilitates the reaction. Nonetheless, in order to avoid the presence of chlorine in the grafted product and derivatives thereof, it is preferred to conduct the grafting reaction thermally or in the presence of a free radical initiator.

The "ene" process is described in the literature, for example in U.S. Pat. No. 3,412,111 and Ben et al, "The Ene Reaction of Maleic Anhydride With Alkenes", J. C. S Perkin II (1977), pp. 535–537, both of which are incorporated herein by reference for relevant disclosures contained therein.

Chlorine assisted grafting is described in numerous patents including U.S. Pat. Nos. 3,215,707; 3,912,764; and 4,234,435, which are incorporated herein by reference.

Typically, from about 90 to about 99.9%, often 100% of carbon to carbon bonds in the polymer are saturated. As noted, the choice of grafting procedure typically depends upon the extent of olefinic unsaturation present in the polymer. Free radical initiators are typically used when the polymer is substantially saturated; the thermal "ene" process may be used when the polymer contains significant amounts of olefinic unsaturation.

Aromatic unsaturation is not considered olefinic unsaturation within the context of this invention. Depending on hydrogenation conditions, up to about 20% of aromatic groups may be hydrogenated; however, typically no more than about 5%, usually less than 1% of aromatic bonds are hydrogenated. Most often, substantially none of the aromatic bonds are hydrogenated.

In one typical embodiment, the polymer contains an average of from 1 to about 9,000 olefinic double bonds, more often from about 1 to about 100 olefinic double bonds, even more often from about 1, frequently 2 to about 10, up to about 50, olefinic double bonds per molecule based on the $\overline{M}_n$ of the polymer. In another embodiment, the polymer contains about 1 olefinic double bond for about every 20, often for about every 70 to 7000 carbon atoms. In still another embodiment, the hydrocarbon polymer contains about 1 olefinic double bond for every 4,000 to 20,000 on $\overline{M}_n$ basis, often, about 1 olefinic double bond per 1,000 to 40,000 on $\overline{M}_n$ basis. Thus, for example, in this embodiment a polymer of $\overline{M}_n$ =80,000 would contain from about 2 to about 80 olefinic double bonds per molecule, often from about 4 to about 20 double bonds per molecule. In yet another embodiment, the hydrocarbon polymer (P) contains about 1 olefinic double bond for about every 300 to 100,000 on $\overline{M}_n$ basis.

As noted hereinabove, in another embodiment, the polymer is substantially saturated, as defined hereinabove.

The equivalent weight per mole of carbon to carbon double bonds is defined herein as the mole-equivalent weight. For example, a polymer having $\overline{M}_n$ of 100,000 and which contains an average of 4 moles of carbon to carbon double bonds, has a mole equivalent weight of 100,000/4= 25,000. Conversely, the polymer has one mole of carbon to carbon double bonds per 25,000 $\overline{M}_n$.

In preferred embodiments, the hydrocarbon polymer is at least one oil soluble or dispersible homopolymer or copolymer selected from the group consisting of:

(1) polymers of dienes;

(2) copolymers of conjugated dienes with vinyl substituted aromatic compounds;

(3) polymers of aliphatic olefins having from 2 to about 28 carbon atoms;

(4) olefin-diene copolymers; and (5) star polymers.

These preferred polymers are described in greater detail hereinbelow.

(1) Polymers of Dienes

The hydrocarbon polymer may be a homopolymer or copolymer of one or more dienes. The dienes may be conjugated such as isoprene, butadiene and piperylene or non-conjugated such as 1–4 hexadiene, ethylidene norbomene, vinyl norbomene, 4-vinyl cyclohexene, and dicyclopentadiene. Polymers of conjugated dienes are preferred. Such polymers are conveniently prepared via free radical and anionic polymerization techniques. Emulsion techniques are commonly employed for free radical polymerization.

As noted hereinabove, useful polymers have $\overline{M}_n$ ranging from about 20,000 to about 500,000. More often, useful polymers of this type have $\overline{M}_n$ ranging from about 50,000 to about 150,000.

These polymers may be and often are hydrogenated to reduce the amount of olefinic unsaturation present in the polymer. They may or may not be exhaustively hydrogenated. Hydrogenation is often accomplished employing catalytic methods. Catalytic techniques employing hydrogen under high pressure and at elevated temperature are well-known to those skilled in the chemical art. Other methods are also useful and are well known to those skilled in the art.

Extensive discussions of diene polymers appear in the "Encyclopedia of Polymer Science and Engineering", Volume 2, pp. 550–586 and Volume 8, pp. 499–532, Wiley-Interscience (1986), which are hereby: expressly incorporated herein by reference for relevant disclosures in this regard.

The polymers include homopolymers and copolymers of conjugated dienes including polymers of 1,3-dienes of the formula

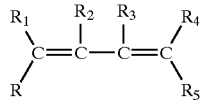

wherein each substituent denoted by R, or R with a numerical subscript, is independently hydrogen or hydrocarbon based, wherein hydrocarbon based is as defined hereinabove. Preferably at least one substituent is H. Normally, the total carbon content of the diene will not exceed 20 carbons. Preferred dienes for preparation of the polymer are piperylene, isoprene, 2,3-dimethyl-1,3-butadiene, chloroprene and 1,3-butadiene.

Suitable homopolymers of conjugated dienes are described, and methods for their preparation are given in numerous U.S. patents, including the following:

U.S. Pat. Nos.

3,547,821

3,835,053

3,959,161

3,965,019

4,085,055

4,116,917

As a specific example, U.S. Pat. No. 3,959,161 teaches the preparation of hydrogenated polybutadiene. In another example, upon hydrogenation, 1,4-polyisoprene becomes an alternating copolymer of ethylene and propylene.

Copolymers of conjugated dienes are prepared from two or more conjugated dienes. Useful dienes are the same as those described in the preparation of homopolymers of conjugated dienes hereinabove. The following U.S. Patents describe diene copolymers and methods for preparing them:

U.S. Pat. Nos.

3,965,019

4,073,737

4,085,055

4,116,917

For example, U.S. Pat. No. 4,073,737 describes the preparation and hydrogenation of butadiene-isoprene copolymers.

(2) Copolymers of Conjugated Dienes with Vinyl Substituted Aromatic Compounds In one embodiment, the hydrocarbon polymer is a copolymer of a vinyl-substituted aromatic compound and a conjugated diene. The vinyl substituted aromatics generally contain from 8 to about 20 carbons, preferably from 8 to 12 carbon atoms and most preferably, 8 or 9 carbon atoms.

Examples of vinyl substituted aromatics include vinyl anthracenes, vinyl naphthalenes and vinyl benzenes (styrenic compounds). Styrenic compounds are preferred, examples being styrene, alpha-methystyrene, ortho-methyl styrene, meta-methyl styrene, para-methyl styrene, para-tertiary-butylstyrene and chlorostyrene, with styrene being preferred.

The conjugated dienes generally have from 4 to about 10 carbon atoms and preferably from 4 to 6 carbon atoms. Example of conjugated dienes include piperylene, 2,3-dimethyl-1,3-butadiene, chloroprene, isoprene and 1,3-butadiene, with isoprene and 1,3-butadiene being particularly preferred. Mixtures of such conjugated dienes are useful.

The vinyl substituted aromatic content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

The polymers, and in particular, styrene-diene copolymers, can be random copolymers or block copolymers, which include regular block copolymers or random block copolymers. Random copolymers are those in which the comonomers are randomly, or nearly randomly, arranged in the polymer chain with no significant blocking of homopolymer of either monomer. Regular block copolymers are those in which a small number of relatively long chains of homopolymer of one type of monomer are alternately joined to a small number of relatively long chains of homopolymer of another type of monomer. Random block copolymers are those in which a larger number of relatively short segments of homopolymer of one type of monomer alternate with relatively short segments of homopolymer of another monomer.

The random, regular block and random block polymers used in this invention may be linear, or they may be partially or highly branched. The relative arrangement of homopolymer segments in a linear regular block or random block polymer is obvious. Differences in structure lie in the number and relative sizes of the homopolymer segments; the arrangement in a linear block polymer of either type is always alternating in homopolymer segments.

Normal or regular block copolymers usually have from 1 to about 5, often 1 to about 3, preferably only from 1 to about 2 relatively large homopolymer blocks of each monomer. Thus, a linear regular diblock copolymer of styrene or other vinyl aromatic monomer (S) and diene (D) would have a general structure represented by a large block of homopolymer (S) attached to a large block of homopolymer (D), as:

$$(S)_s(D)_d$$

where subscripts s and d are as described hereinbelow. Similarly, a regular linear tri-block copolymer of styrene or other vinyl aromatic monomer (S) and diene monomer (D) may be represented, for example, by $$(S)_s(D)_d(S)_s \text{ or } (D))_d(S)_s(D)_d.$$

Techniques vary for the preparation of these "S-D-S" and "D-S-D" triblock polymers, and are described in the literature for anionic polymerization.

A third monomer (T) may be incorporated into linear, regular block copolymers. Several configurations are possible depending on how the homopolymer segments are arranged with respect to each other. For example, linear triblock copolymers of monomers (S), (D) and (T) can be represented by the general configurations:

$$(S)_s\text{-}(D)_d\text{-}(T)_t,\ (S)_s\text{-}(T)_t\text{-}(D)_d,\ \text{or}\ (D)_d\text{-}(S)_s\text{-}(T)_t,$$

wherein the lower case letters s, d and t represent the approximate number of monomer units in the indicated block.

The sizes of the blocks are not necessarily the same, but may vary considerably. The only stipulation is that any regular block copolymer comprises relatively few, but relatively large, alternating homopolymer segments.

As an example, when (D) represents blocks derived from diene such as isoprene or butadiene, "d" usually ranges from about 100 to about 2000, preferably from about 500 to about 1500; when (S) represents, for example, blocks derived from styrene, "s" usually ranges from about 100 to about 2000, preferably from about 200 to about 1000; and when a third block (T) is present, "t" usually ranges from about 10 to about 1000, provided that the $\overline{M}_n$ of the polymer is within the ranges indicated as useful for this invention.

The copolymers can be prepared by methods well known in the art. Such copolymers usually are prepared by anionic polymerization using Group Ia metals in the presence of electron-acceptor aromatics, or preformed organometallics such as sec-butyllithium as polymerization catalysts.

The styreneldiene block polymers are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group Ia metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion. The carbanionic terminus remains an active initiation site toward additional monomers. The resulting polymers, when monomer is completely depleted, will usually all be of similar molecular weight and composition, and the polymer product will be "monodisperse" (i.e., the ratio of weight average molecular weight to number average molecular weight is very nearly 1.0). At this point, addition of 1,3-butadiene, isoprene or other suitable anionically polymerizable monomer to the homopolystyrene-lithium "living" polymer produces a second segment which grows from the terminal anion site to produce a living di-block polymer having an anionic terminus, with lithium gegenion.

Subsequent introduction of additional styrene can produce a new poly S-block-poly D-block-poly S, or S-D-S triblock polymer; higher orders of block polymers can be made by consecutive stepwise additions of different monomers in different sequences.

Alternatively, a living diblock polymer can be coupled by exposure to an agent such as a dialkyl dichlorosilane. When the carbanionic "heads" of two S-D diblock living polymers are coupled using such an agent, precipitation of LiCl occurs to give an S-D-S triblock polymer.

Block copolymers made by consecutive addition of styrene to give a relatively large homopolymer segment (S), followed by a diene to give a relatively large homopolymer segment (D), are referred to as poly-S-block-poly-D copolymers, or S-D diblock polymers.

When metal naphthalide is employed as initiator, the dianion formed by electron transfer from metal, e.g., Na, atoms to the naphthalene ring can generate dianions which may initiate polymerization, e.g. of monomer S, in two directions simultaneously, producing essentially a homopolymer of S having anionic termini at both ends.

Subsequent exposure of the poly (S) dianion to a second monomer (D) results in formation of a poly D-block-poly S-block-poly D, or a D-S-D triblock polymeric dianion, which may continue to interact with additional anionically-polymerizable monomers of the same, or different chemical type, in the formation of higher order block polymers. Ordinary block copolymers are generally considered to have up to about 5 such blocks.

Usually, one monomer or another in a mixture will polymerize faster, leading to a segment that is richer in that monomer, interrupted by occasional incorporation of the other monomer. This can be used to build a type of polymer referred to as a "random block polymer", or "tapered block polymer". When a mixture of two different monomers is anionicady polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, resulting in a "tapered block copolymer."An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis-addition.

These polymers may have considerable olefinic unsaturation, which may be reduced, if desired. Hydrogenation to reduce the extent of olefinic unsaturation may be carried out to reduce approximately 90–99.1% of the olefinic unsaturation of the initial polymer, such that from about 90 to about 99.9% of the carbon to carbon bonds of the polymer are saturated. In general, it is preferred that these copolymers contain no more than about 10%, preferably no more than 5% and often no more than about 0.5% residual olefinic unsaturation on the basis of the total amount of olefinic double bonds present in the polymer prior to hydrogenation. Unsaturation can be measured by a number of means well known to those of skill in the art, including infrared, nuclear magnetic resonance spectroscopy, bromine number, iodine number, and other means. Aromatic unsaturation is not considered to be olefinic unsaturation within the context of this invention.

Hydrogenation techniques are well known to those of skill in the art. One common method is to contact the copolymers with, hydrogen, often at superatmospheric pressure in the presence of a metal catalyst such as colloidal nickel, palladium supported on charcoal, etc. Hydrogenation may be carried out as part of the overall production process, using finely divided, or supported, nickel catalyst. Other transition metals may also be used to effect the transformation. Other techniques are known in the art.

Other polymerization techniques such as emulsion polymerization can be used.

Often the arrangement of the various homopolymer blocks is dictated by the reaction conditions such as catalyst and polymerization characteristics of the monomers employed. Conditions for modifying arrangement of polymer blocks are well known to those of skill in the polymer art. Literature references relating to polymerization techniques and methods for preparing certain types of block polymers include:

1) "Encyclopedia of Polymer Science and Engineering", Wiley-Interscience Publishing, New York, (1986);
2) A. Noshay and J. E. McGrath, "Block Copolymers", Academic Press, New York, (1977);
3) R. J. Ceresa, ed., "Block and Graft Copolymerization", John Wiley and Sons, New York, (1976); and
4) D. J. Meier, ed., (Block Copolymers", MMI Press, Harwood Academic Publishers, New York, (1979).

Each of these is hereby incorporated herein by reference for relevant disclosures relating to block copolymers.

Examples of suitable commercially available regular linear diblock copolymers as set forth above include SBELLVIS®-40, and SHELLVIS®-50, both hydrogenated styrene-isoprene block copolymers, manufactured by Shell Chemical.

Examples of commercially available random block and tapered block copolymers include the various GLISSOVISCAL® styrene-butadiene copolymers manufactured by BASF. A previously available random block copolymer was PHIL-AD® viscosity improver, manufactured by Phillips Petroleum.

The copolymers preferably have $\overline{M}_n$ in the range of about 20,000 to about 500,000, more preferably from about 30,000 to about 150,000. The weight average molecular weight ($\overline{M}_w$) for these copolymers is generally in the range of about 50,000 to about 500,000, preferably from about 50,000 to about 300,000.

Copolymers of conjugated dienes with olefins containing aromatic groups, e.g., styrene, methyl styrene, etc. are described in numerous patents including the following:

| |
|---|
| 3,554,911 |
| 3,992,310 |
| 3,994,815 |
| 4,031,020 |
| 4,073,738 |
| 4,077,893 |
| 4,082,680 |
| 4,085,055 |
| 4,116,917 |
| 4,136,048 |
| 4,145,298 |

For example, U.S. Pat. No. 3,554,911 describes a random butadiene-styrene copolymer, its preparation and hydrogenation.

(3) Polymers of Aliphatic Olefins

Another useful hydrocarbon polymer is one which in its main chain is composed essentially of aliphatic olefin, especially alpha olefin, monomers. The polyolefins of this embodiment thus exclude polymers which have a large component of other types of monomers copolymerized in the main polymer , such as ester monomers, acid monomers, and the like. The polyolefin may contain impurity amounts of such materials, e.g., less than 5% by weight, more often less than 1% by weight, preferably, less than 0.1% by weight of other monomers. Useful polymers include oil soluble or dispersible polymers of alpha-olefins.

The olefin copolymer preferably has a number average molecular weight ($\overline{M}_n$) determined by gel-permeation chromatography employing polystyrene standards, ranging from about 20,000 to about 500,000, often from about 30,000 to about 300,000, often to about 200,000, more often from about 50,000 to about 150,000, even more often from about 80,000 to about 150,000. Exemplary polydispersity values ($\overline{M}_w/\overline{M}_n$) range from about 1.5 to about 3.5, often to about 3.0, preferably, from about 1.7, often from about 2.0, to about 2.5.

These polymers may be homopolymers or copolymers and are preferably polymers of alpha-olefins having from 2 to about 28 carbon atoms. Preferably they are copolymers, more preferably copolymers of ethylene and at least one other α-olefin having from 3 to about 28 carbon atoms, i.e., one of the formula $CH_2{=}CHR_1$ wherein $R_1$ is straight chain or branched chain alkyl radical comprising 1 to 26 carbon atoms. Preferably $R_1$ is alkyl of from 1 to 8 carbon atoms, and more preferably is alkyl of from 1 to 2 carbon atoms. Examples include homopolymers from monoolefins such as propylene, 1-butene, isobutene, 1-pentene, 1-hexene, 4-methyl-1-pentene, 1-beptene, 1-octene, 1-nonene, 1-decene, etc and copolymers, preferably of ethylene with one or more of these monomers. Preferably, the polymer of olefins is an ethylene-propylene copolymer.

The ethylene content is preferably in the range of 20 to 80 percent by weight, and more preferably 30 to 70 percent by weight. When propylene and/or 1-butene are employed as comonomer(s) with ethylene, the ethylene content of such copolymers most preferably is 45 to 65 percent, although higher or lower ethylene contents may be present. Most preferably, these polymers are substantially free of ethylene homopolymer, although they may exhibit a degree of crystallinity due to the presence of small crystalline polyethylene segments within their microstructure.

In one particular embodiment, the polymer is a homopolymer derived from a butene, particularly, isobutylene. Especially preferred is where the polymer comprises terminal vinylidene olefinic double bonds.

The polymers employed in this embodiment may generally be prepared substantially in accordance with procedures which are well known in the art.

Catalysts employed in the production of the reactant polymers are likewise well known. One broad class of catalysts particularly suitable for polymerization of α-olefins, comprises coordination catalysts such as Ziegler or Ziegler-Natta catalysts comprising a transition metal atom. Ziegler-Natta catalysts are composed of a combination of a transition metal atom with an organo aluminum halide and may be used with additional complexing agents.

Other useful polymerization catalysts are the metallocene compounds. These are organometallic coordination compounds obtained as cyclopentadienyl derivatives of a transition metal or metal halide. The metal is bonded to the cyclopentadienyl ring by electrons moving in orbitals extending above and below the plane of the ring (πbond). The use of such materials as catalysts for the preparation of ethylene-alpha olefin copolymers is described in U.S. Pat. No. 5,446,221. The procedure described therein provides ethylene-alpha olefin copolymers having at least 30% of terminal ethenylidene unsaturation. This patent is hereby incorporated herein by reference for relevant disclosures.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will generally be completed at a pressure of 1 to 40 MPa (10 to 400 bar).

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, component(s) of the catalyst are introduced while agitating the reaction mixture, thereby causing polymerization to commence. Alternatively, component(s) of the catalyst may be premixed in a solvent and then fed to the reactor. As polymer is being formed, additional monomers may be added to the reactor. Upon completion of the reaction, unreacted monomer and solvent are either flashed or distilled off, if necessary by vacuum, and the copolymer withdrawn from the reactor.

The polymerization may be conducted in a continuous manner by simultaneously feeding the reaction diluent (if employed), monomers, component(s) of the catalyst to a reactor and withdrawing solvent, unreacted monomer and polymer from the reactor so as to allow a residence time of ingredients long enough for forming polymer of the desired molecular weight; and separating the polymer from the reaction mixture.

In those situations wherein the molecular weight of the polymer product that would be produced at a given set of operating conditions is higher than desired, any of the techniques known in the prior art for control of molecular weight, such as polymerization temperature control, may be used.

The polymers are preferably formed in the substantial absence of added $H_2$ gas, that is, $H_2$ gas added in amounts effective to substantially reduce the polymer molecular weight.

The polymers can be random copolymers, block copolymers, and random block copolymers. Ethylene propylene copolymers are usually random copolymers. Block copolymers may be obtained by conducting the reaction in a tubular reactor. Such a procedure is described in U.S. Pat. No. 4,804,794 which is hereby incorporated by reference for relevant disclosures in this regard.

Numerous United States patents, including the following, describe the preparation of copolymers of alpha olefins.

| U.S. Pat. Nos. |
|---|
| 3,513,096 |
| 3,551,336 |
| 3,562,160 |
| 3,607,749 |
| 3,634,249 |
| 3,637,503 |
| 3,992,310 |
| 4,031,020 |
| 4,068,056 |
| 4,068,057 |
| 4,081,391 |
| 4,089,794 |
| 4,098,710 |
| 4,113,636 |
| 4,132,661 |
| 4,137,185 |
| 4,138,370 |
| 4,144,181 |
| 3,291,780 |
| 3,300,459 |
| 3,598,738 |
| 4,026,809 |
| 4,032,700 |
| 4,156,061 |
| 3,320,019 |
| 4,357,250 |

Copolymers of ethylene with higher alpha olefins are the most common copolymers of aliphatic olefins. Ethylene-propylene copolymers are the most common ethylene-alpha-olefin copolymers and are preferred for use in this invention. A description of an ethylene-propylene copolymer appears in U.S. Pat. No. 4,137,185 which is hereby incorporated herein by reference.

Useful ethylene-alpha olefin, usually ethylene-propylene, copolymers are commercially available from numerous sources including the Exxon, Texaco and Lubrizol Corporations.

(4) Olefin-Diene Copolymers

Another useful hydrocarbon polymer is one derived from olefins, especially lower olefins, and dienes. Preferred olefins are alpha olefins. Dienes may be non-conjugated or conjugated, usually non-conjugated. Useful olefins and dienes are the same as those described hereinabove and hereinafter in discussions of other polymer types.

In one embodiment, the copolymer is an ethylene-lower olefin-diene copolymer. As used herein, the term lower refers to groups or compounds containing no more than 7 carbon atoms. Preferably, the diene is non-conjugated. Especially preferred are ethylene-propylene-diene copolymers.

These copolymers most often will have $\overline{M}_n$ ranging from about 20,000 to about 500,000, preferably from about 50,000 to about 200,000. In another embodiment, the $\overline{M}_n$ ranges from about 70,000 to about 350,000. These polymers often have a relatively narrow range of molecular weight as represented by the polydispersity value $\overline{M}_w/\overline{M}_n$. Typically, the polydispersity values are less than 10, more often less than 6, and preferably less than 4, often between 2 and 3.

There are numerous commercial sources for lower olefin-diene copolymers. For example, ORTHOLEUM® 2052 (a product marketed by the DuPont Company) which is a terpolymer having an ethylene:propylene weight ratio of about 57:43 and containing 4–5 weight % of groups derived from 1,4-hexadiene monomer. Other commercially available olefin-diene copolymers including ethylene-propylene copolymers with ethylidene norbornene, with dicyclopentadiene, with vinyl norbornene, with piperylene (1,3-pentadiene), with 4-vinyl cyclohexene, and numerous other such materials are readily available. Olefin-diene copolymers and methods for their preparation are described in numerous patents including the following U.S. Patents:

U.S. Pat. No. 3,598,738, which describes the preparation of ethylene-propylene-1,4-hexadiene terpolymers, is illustrative. This patent also lists numerous references describing the use of various polymerization catalysts.

Another useful polymer is an olefin-conjugated diene copolymer. An example of such a polymer is butyl rubber, an isobutylene-isoprehe copolymer.

Details of various types of polymers, reaction conditions, physical properties, and the like are provided in the above patents and in numerous books, including:

"Riegel's Handbook of Industrial Chemistry", 7th edition, James A. Kent Ed., Van Nostrand Reinhold Co., New York (1974), Chapters 9 and 10, P. J. Flory, "principles of Polymer Chemistry", Cornell University Press, Ithaca, N.Y. (1953), "Kirk-Othmer Encyclopedia of Chemical Technology", 3rd edition, Vol. 8 (Elastomers, Synthetic, and various subheadings thereunder), John Wiley and Sons, New York (1979).

Each of the above-mentioned books and patents is hereby expressly incorporated herein by reference for relevant disclosures contained therein.

Polymerization can also be effected using free radical initiators in a well-known process, generally employing higher pressures than used with coordination catalysts. These polymers may be and frequently are hydrogenated to bring unsaturation to desired levels. As noted, hydrogenation may take place before or after reaction with the carboxylic reactant.

(5) Star Polymer

Star polymers are polymers comprising a nucleus and polymeric arms. Common nuclei include polyalkenyl compounds, usually compounds having at least two non-conjugated alkenyl groups, usually groups attached to electron withdrawing groups, e.g., aromatic nuclei. The polymeric arms are often homopolymers and copolymers of dienes, preferably conjugated dienes, vinyl substituted aromatic compounds such as monoalkenyl arenes, homopolymers of olefins such as butenes, especially isobutene, and mixtures thereof.

Molecular weights (GPC peak) of useful star polymers range from about 20,000, often from about 50,000 to about 500,000. They frequently have $\overline{M}_n$ ranging from about 100,000 to about 250,000.

The polymers thus comprise a poly(polyalkenyl coupling agent) nucleus with polymeric arms extending outward therefrom. The star polymers are usually hydrogenated such that at least 80% of the olefinic carbon-carbon bonds are saturated, more often at least 90% and even more preferably, at least 95% are saturated. As noted herein, the polymers contain olefinic unsaturation; accordingly, they are not exhaustively saturated before reaction with the carboxylic reactant.

The polyvinyl compounds making up the nucleus are illustrated by polyalkenyl arenes, e.g., divinyl benzene and poly vinyl aliphatic compounds.

Dienes making up the polymeric arms are illustrated by butadiene, isoprene and the like. Monoalkenyl compounds include, for example, styrene and alkylated derivatives thereof. In one embodiment, the arms are derived from dienes. In another embodiment, the arms are derived from dienes and vinyl substituted aromatic compounds. In yet another embodiment, the arms comprise polyisobutylene groups, often, isobutylene-conjugated diene copolymers. Arms derived from dienes or from dienes and vinyl substituted aromatic compounds are frequently substantially hydrogenated.

Star polymers are well known in the art. Such material and methods for preparing same are described in numerous publications and patents, including the following United States patents which are hereby incorporated herein by reference for relevant disclosures contained therein:

U.S. Pat. Nos.

4,116,917, 4,141,847, 4,346,193, 4,358,565, and 4,409,120.

Star polymers are commercially available, for example as Sheilvis 200 sold by Shell Chemical Co.

Mixtures of two or more hydrocarbon polymers may be used

αβ-Unsaturated Carboxylic Compound

The α,β-unsaturated carboxylic compound used in the preparation of the hydrocarbyl substituted carboxylic compositions of this invention are themselves prepared by reacting (1) an active methylene compound and (2) a carbonyl compound as described in detail herein. They are preferably polycarboxylic compounds of the general formula

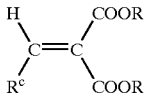

wherein $R^c$ is R;

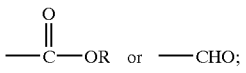

and each R is, independently, H or hydrocarbyl.

With the reaction of dimethyl malonate and the methyl hemiacetal of methyl glyoxylate, a minor amount (ca. 5% yield) of a product having the formula

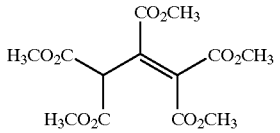

has been obtained.

Several compounds of this type are described in Hall et al, Polymer Bulletin 16, 405–9 (1986); Evans et al, J. Org. Chem 54 2849 (1989); Hall et al, Macromolecules 8 22, (1975); Stetter et all Synthesis 626 (1981); Wilk, Tetrahedron 53, 7097 (1997); Hawkins et al, U.S. Pat. No. 4,049, 698 and Roblin et al U.S. Pat. No. 2,293,309.

The reacting of (1) an active methylene compound and (2) a carbonyl compound take place with or without solvent and with or without catalyst. Generally, the reaction takes place at temperatures between about 120° C. and 170° for 4 to 8 hours with liberated water being removed during reaction. The Knoevenagel reaction wherein α,β-unsaturated compounds can be prepared by reaction of active methylene compounds with aldehydes is illustrative. Such reactions take place with or without solvent and with or without catalyst. Generally, the reaction takes place at temperatures between about 120° C. and 170° for 4 to 8 hours with liberated water being removed during reaction. The reaction products are often fractionally distilled to obtained the desired α,β-unsaturated compound.

The reaction products are often fractionally distilled to obtained the desired α,β-unsaturated compound.

Active Methylene Compound

Active methylene compounds (1) used to prepare (B) the α,β-unsaturated carboxylic compound have the general formula

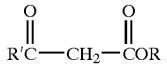

wherein each R' is independently R or OR and each R is, independently, H or a hydrocarbyl group. Useful active methylene compounds include malonic acid and esters thereof, especially di-lower alkyl malonate esters, and acetoacetic acid esters, particularly, lower alkyl, such as methyl, ethyl and propyl acetoacetates.

Especially preferred di-lower alkyl malonate esters are dimethyl malonate, diethyl malonate and methyl ethyl malonate. Especially preferred lower alkyl acetoacetates include methyl- or ethyl-acetoacetate.

Carbonyl Compound

Carbonyl compounds used to prepare (B) the α,β-unsaturated carboxylic compound have the general formula

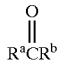

wherein $R^a$ is H or hydrocarbyl, especially H or lower alkyl, and $R^b$ is a member of the group consisting of H, hydrocarbyl and

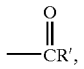

wherein each R' is independently R or OR and each R is, independently, H or a hydrocarbyl group; and lower alkyl acetals, ketals, hemiacetals and hemiketals of the carbonyl compound.

In one embodiment, the carbonyl compound comprises an aldehyde wherein $R^a$ is H and $R^b$ is H or lower alkyl. In another embodiment, the carbonyl compound comprises a ketone wherein each of $R^a$ and $R^b$ is a lower alkyl group. Formaldehyde is a useful aldehyde. Useful ketones include acetone and methyl ethyl ketone.

In a preferred embodiment the carbonyl compound is a compound having the general formula

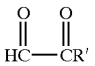

wherein each R' is independently R or OR and each R is, independently, H or a hydrocarbyl group; or a lower alkyl hemiacetal thereof. Preferably, R' is a group of the formula OR wherein R is independently H or lower alkyl.

Preferred carbonyl compounds are glyoxylic acids and reactive equivalents thereof. In one preferred embodiment, the carbonyl compound is glyoxylic acid or the hydrate thereof. Particularly preferred are lower alkyl esters of glyoxylic acid. Especially preferred is a lower alkyl hemiacetal of a lower alkyl glyoxylate, most preferably, the methyl hemiacetal of methyl glyoxylate.

The following examples illustrate several α,β-unsaturated carboxylic compounds used in the preparation of the hydrocarbyl substituted carboxylic compositions of this invention. In these and in examples that follow, unless indicated otherwise, all parts are parts by weight, temperatures are in degrees Celsius, and pressures are atmospheric. The relationship between parts by weight and parts by volume is as grams to milliliters. Filtrations are conducted employing a diatomaceous earth filter aid.

EXAMPLE (B)-1

A reactor is charged with 30 parts dimethyl malonate and 27.2 parts glyoxylic acid methyl ester methyl hemiacetal (hereinafter GMHA). While these are being mixed, 23.17 parts acetic anhydride are added from an addition funnel at ambient temperature. Heating is begun and after 0.7 hour the temperature is 105° C. Heating is continued while distillate is collected in a Dean-Stark trap. Heating is continued for 4.7 hours while the temperature is increased to 130° C. At this point 8 parts by volume distillate has been collected in the Dean-Stark trap. The temperature is increased to 160° C. and is maintained for 7.5 hours while collecting 8.2 parts by volume additional distillate. Heating at 160° C. is continued for 7 hours followed by heating to 200° C. and vacuum distillation at 10 mm Hg pressure. Two fractions are obtained. Yield of desired product is 11.84 parts (25.8%).

EXAMPLE (B)-2

A reactor is charged with 30 parts dimethyl malonate and 27.2 parts GMHA. The materials are heated, under $N_2$ to 140° C. over 1 hour then temperature is maintained for 1.5 hours while collecting 6 parts by volume distillate in Dean-Stark trap The temperature is increased to 160° C. and is maintained for 13 hours. The temperature is increased to 170° C. and the materials are vacuum stripped at 5.2 mm Hg pressure. Solids and clear colorless liquid distill over and 6.48 parts white solid is isolated from the liquid by filtration through filter paper. The solid is the product at 14.13% yield.

EXAMPLE (B)-3

A reactor is charged with 253.73 parts dimethyl malonate and 230.65 parts GMHA. The materials are heated, under $N_2$ to 117° C. then to 125° C. over 5 hours while collecting 50 parts by volume distillate in a Dean-Stark trap. The temperature is increased to 130° C. then to 170° C. over 6.5 hours while collecting an additional 36.2 parts distillate. The temperature is increased to a maximum of 188° C. at 4.5 mm Hg pressure while collecting 199.65 parts distillate (51% yield). The distillate is the product.

EXAMPLE (B)-4

A reactor is charged with, 132.12 parts dimethyl malonate and 120.1 parts GMHA. To the stirring mixture are added 1.79 parts dibutylamine. The materials are heated under $N_2$, to 130° C. over 8.25 hours while collecting a total of 36.5 parts by weight distillate in a Dean-Stark trap. The materials are cooled to 110° C. and vacuum distilled. The fraction collected at 6–10 mm Hg pressure and head temperature 134–152° C. (93.9 parts, 46.4% yield) is the product.

EXAMPLE (B)-5

A reactor is charged with 132.12 parts dimethyl malonate and 120.1parts GMHA. The materials are heated, under $N_2$, over 7 hours while collecting a total of 273 parts by volume (235 parts by weight) distillate in a Dean-Stark trap. The temperature is increased to 170° C. and the materials are vacuum distilled. The fraction collected at 156–171° C. pot temperature (21–5 mm Hg pressure, 139–170° C. head temperature) (398.95 parts, 39.5% yield) is the product.

EXAMPLE (B)-6

A reactor is charged with 264.24 parts dimethyl malonate, 240.2 parts GMHA and 5.49 parts 70% aqueous methane sulfonic acid. The materials are heated to 140° C. over 6.25 hours while collecting a total of 63.8 parts distillate in a Dean-Stark trap. The temperature is increased to 160° C. and is maintained for 2.5 hours while collecting an additional 29 parts by volume distillate. The materials are vacuum distilled collecting 230.68 parts, (57.07% yield) at pot temperature 154–162° C., head temperature 130–140° C. and 5.6–30 mm Hg pressure as the product.

EXAMPLE (B)-7

A reactor is charged with 132.12 parts dimethyl malonate, 120.01 parts GMHA and 0.89 parts β-alanine. The materials are heated, under $N_2$, to 130° C. while collecting a total of 13.58 parts distillate in a Dean-Stark trap. The temperature is increased to 160° C. over 4.5 hours and is maintained for 2 hours while collecting an additional 11,65 parts distillate. The materials are vacuum distilled collecting 93.73 parts (46.37% yield) at pot temperature of 134–178° C., head temperature 108–120° C. at 4.4–7.5 mm Hg pressure as the product.

EXAMPLE (B)-8

A reactor is charged with 132.12 parts dimethyl malonate, 120.01 parts GMRA and 1.77 parts 30% aqueous $NH_4OH$. The materials are heated, under $N_2$, to 151° C. over 3 hours while collecting a total of 30.5 parts distillate in a Dean-Stark trap. The materials are vacuum distilled collecting 54.07 parts (26.74% yield) at pot temperature 145–157° C., head temperature 100–134° C. at 6–7.8 mm Hg pressure as the product.

EXAMPLE (B)-9

A reactor is charged with 532.3 parts GMHA, 585.6 parts dimethyl malonate and 6.08 parts 70% aqueous methanesulfonic acid. The materials are heated, under $N_2$, to 130° C. over 5.5 hours while collecting 43.79 parts distillate in a Dean-Stark trap. The temperature is increased to 140° C. and is maintained for 1 hour while collecting an additional 91.82 parts distillate. The temperature is increased to 150° C. over 1 hour and is maintained for 5.5 hours while collecting an additional 84.3 parts distillate. To the residue are added 4.62 parts $Na_2CO_3$, the materials are filtered then vacuum distilled to 150° C. and 10 mm Hg pressure. The fraction distilling at 100–130° C. (246.01 parts, 27.5% yield) is collected as the product.

EXAMPLE (B)-10

A reactor is charged with 720.6 parts GMHA and 660 parts dimethyl malonate. The materials are heated, under $N_2$, to 120° C. over 6 hours, collecting 81.22 parts distillate in a Dean-Stark trap. The temperature is increased to 150° C. over 6 hours, collecting an additional 121.93 parts distillate. The temperature is maintained for 6 hours, collecting an additional 47.52 parts distillate. The materials are vacuum distilled collecting 401.69 parts (39.7% yield) at 150–160° C. pot temperature, 100–127° C. head temperature at 5 mm Hg pressure as the product.

EXAMPLE (B)-11

A reactor is charged with 160.17 parts dimethyl malonate and 120.1 parts GMHA. The materials are heated under $N_2$ to 150° C. over 8 hours, collecting a total of 43 parts by volume distillate in a Dean-Stark trap. The temperature is maintained for 4 hours, collecting an additional 37.8 parts distillate. The materials are vacuum distilled. The fraction distilling 100–120° C. head temperature at 3.3 mm Hg pressure (121.87 parts, 52.9% yield) is collected as product.

EXAMPLE (B)-12

A reactor is charged with 30 parts dimethyl malonate, 27.2 parts GMHA and 0.62 parts 70% aqueous methanesulfonic acid. The materials are heated to 160° C. over 5 hours then the temperature is maintained for 3 hours. The materials are vacuum stripped to 130° C. and 4.9 mm Hg. The solid-liquid mixture is obtained. The mixture is filtered through paper and 12,85 parts white solids (28% yield) is collected as the product.

EXAMPLE (B)-13

A reactor is charged with 240.2 parts GMHA, 264.24 parts dimethyl malonate and 25 parts of sulfonated poly (styrene-co-divinylbenzene) resin (AMBERLYST® 35, Rohm and Haas)). The materials are heated, under $N_2$, to 120° C. over 7 hours, then maintained at temperature for 13.5 hours. The materials are filtered to remove Amberlyst 35, and the liquid filtrate is vacuum distilled. The fraction distilling at 150° C. pot temperature, 95–125° C. head temperature at 8.3 mm Hg pressure (138.1 parts, 34.1% yield, is collected as the product.

EXAMPLE (B)-14

A reactor is charged with 65.07 parts ethyl acetoacetate, 61.02 parts GMHA, 5.0 parts 3-aminopropyl-functionalized silica gel and 100 parts by volume toluene. The materials are heated, under $N_2$, to 70° C. over 0,5 hour, then temperature is maintained for hours. The temperature is increased to 80° C. over 3.25 hour then to 90° C. over 2 hours. The temperature is maintained at 90° C. for 7 hours. The materials are vacuum distilled. The fraction distilling at 130° C. pot temperature, 115° C. head temperature at 5.4 mm Hg pressure (55.3 parts, 54.7% yield, is collected as the product. The product is 93.3% triethyl ethylenetricarboxylate as determined by gas chromatography/MS.

EXAMPLE (B)-15

A reactor is charged with 300 parts dimethyl malonate and 272.7 parts GMHA. The materials are heated, under $N_2$, to 123° C. at which time a strong reflux is observed. The materials are heated to 170° C. over 6.5 hours while 107.1 parts distillate are collected. The residue, 400.9 parts, 87.3% yield is the product.

EXAMPLE (B)-16

The crude liquid product (225 parts) of Example (B)-15 is vacuum distilled at maximum pot temperature of 200° C. and 4 mm Hg pressure. The distillate, a white solid in a clear liquid (total 148.87 parts) is collected and is the product.

EXAMPLE (B)-17

A reactor is charged with 1322.2 parts dimethyl malonate and 1201.8 parts GMHA. The materials are heated, under $N_2$ to 150° C. over 5 hours then temperature is maintained for 5 hours. The temperature is increased to 145° C., is maintained for 1 hour, then is increased to 150° C. and is maintained at temperature for 4 hours. A total of 427.38 parts distillate is collected. The materials are vacuum distilled, collecting the fraction distilling at 130–150° C./5 mm Hg pressure (477.3 parts, 23.6% yield).

EXAMPLE (B)-18

A reactor is charged with 260.28 parts ethyl acetoacetate, 240.2 parts GMHA, 20 parts 3-aminopropyl-functionalized silica gel and 400 parts by volume toluene. The materials are heated, under $N_2$, to 90° C. over 1 hour then temperature is maintained at 90° C. for 7.5 hours while removing distillate. The materials are filtered through filter paper which is subsequently washed with 100 parts by volume toluene. The filtrate and washings are vacuum stripped to 110° C. pot temperature (80° C. head temperature) at 3 mm Hg pressure, yielding 367.51 parts (91.78% yield) as the major product.

EXAMPLE (B)-19

A portion of the product of Example (B)-18 (280 parts) is vacuum distilled to 135° C. and 4 mm Hg pressure yielding 233.07 parts distillate as product.

Hydrocarbyl Group Substituted Carboxylic Compositions

This invention is also directed to hydrocarbyl group substituted carboxylic compositions and a process for preparing said carboxylic compositions comprising reacting (A) a hydrocarbon polymer having $\overline{M}_n$ ranging from about 20,000 to about 500,000, and (B) an α,β-unsaturated carboxylic compound prepared by reacting (1) an active methylene compound of the formula

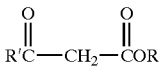

and (2) a carbonyl compound of the general formula

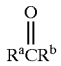

wherein $R^a$ is H or hydrocarbyl and $R^b$ is a member of the group consisting of H, hydrocarbyl and

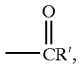

wherein each R' is independendy R or OR and each R is, independently, H or a hydrocarbyl group; and lower alkyl acetals, ketals, hemiacetals and hemiketals of the carbonyl compound (2). Preferred reactants for use in the process are the same as those described hereinabove.

Reactants (A) and (B) are generally reacted in amounts ranging from about 0.95 to about 4 moles (B) per equivalent of (A), wherein an equivalent of (A) is defined as the molecular weight of (A) divided by the number of olefinic groups therein. For example, the equivalent weight of a EPDM co-polymer having molecular weight of 20,000 and containing 4 olefinic groups is 5,000. In one preferred embodiment, about 3 moles (B) are reacted per equivalent of (A), while in another preferred embodiment, about 1 mole (B) is reacted with one equivalent of (A).

The process may be conducted at ambient pressure, under superatmospheric pressure or under reduced pressure. Usually, except when volatile by-products are being removed from the reaction mixture under reduced pressure, there is usually no advantage to conduct the reaction under other than ambient pressure.

When the hydrocarbon polymer is substantially saturated, the process is conducted employing free radical conditions.

Radical grafting is preferably carried out using free radical initiators such as peroxides, hydroperoxides, and azo compounds which decompose thermally within the grafting temperature range to provide said free radicals.

Free radical generating reagents are well know to those skilled in the art. Examples include benzoyl peroxide, t-butyl perbenzoate, t-butyl metachloroperbenzoate, t-butyl peroxide, sec-butylperoxydicarbonate, azobisisobutyronitrile, and the like. Numerous examples of free radical-generating reagents, also known as free-radical initiators, are mentioned in the above-referenced tests by Flory and by Bovey and Winslow. An extensive listing of free-radical initiators appears in J. Brandrup and E. H. limergut, Editor, "Polymer Handbook", 2nd edition, John Wiley and Sons, New York (1975), pages II-1 to II-40. Preferred free radical-generating reagents include t-butyl peroxide, t-butylhydroperoxide, t-butyl perbenzoate, t-amyl peroxide, cumyl peroxide, t-butyl peroctoate, t-butyl-m-chloroperbenzoate and azobisisovaleronitrile.

The free-radical initiators are generally used in an amount from 0.01 to about 10 percent by weight based on the total weight of the reactants. Preferably, the initiators are used at about 0.05 to about 1 percent by weight.

The reaction is usually conducted at temperatures ranging between about 80° C. to about 200° C., preferably between about 130° C. to about 170° C. Considerations for determining reaction temperatures include reactivity of the system and the half-life of the initiator at a particular temperature.

The choice of free radical generating reagent can be an important consideration. For example, when a polymer undergoing grafting with a monomer is diluted with a solvent such as a hydrocarbon oil, grafting of the monomer onto the oil diluent may occur. It has been observed that the choice of initiator affects the extent of grafting of the monomer onto the oil diluent. Reducing the amount of monomer grafted onto the diluent usually results in an increased amount of monomer grafted onto the polymer. Improved efficiency of monomer grafting onto substantially saturated copolymer resins has been described by Lange et al. in U.S. Pat. No. 5,298,565 which is hereby incorporated herein by reference for relevant disclosures in this regard.

When the hydrocarbon polymer is olefinically unsaturated, the process may be conducted thermally at temperatures ranging from ambient, usually from at least about 20° C. up to about 250° C., more often from about 80° C. to about 220° C.

In one embodiment, the process is conducted wherein said reacting of (A) the hydrocarbon polymer and (B) the α,β-unsaturated carboxylic compound is conducted with the addition of from about 0.1 to about 2.5 moles $Cl_2$ per mole of (B) polycarboxylic compound. In another embodiment, the reacting is conducted with the addition of from about 0.1 to about 2.2 moles $Cl_2$ per equivalent of olefinically unsaturated hydrocarbon. The process with added chlorine is also generally conducted at an elevated temperature, typically from about 130° C. up to about 200° C.

The following examples illustrate hydrocarbyl group substituted carboxylic compositions of this invention. Temperatures, pressures, and amounts are expressed in terms as set forth hereinabove. Filtrations are conducted employing a diatomaceous earth filter aid.

EXAMPLE 1

A reactor is charged with 2000 parts of a 14 weight % in mineral oil solution of an ethylene/propylene/dicyclopentadiene copolymer (weight ratio of 63/36/1.5) having $\overline{M}_w$ 150,000 and an average of about 12 C=C per molecule (Uniroyal Chemical). The solution is heated with stirring to 100° C. under $N_2$, 10 parts of the product of Example (B)-5 are added then the temperature is increased to 130° C. A solution of 5 parts t-butyl peroxybenzoate and 5 parts toluene is added dropwise over 0.75 hour. The temperature is maintained for 3 hours then the materials are cooled whereupon streaks of solid material appeared on reactor walls. Toluene, 200 parts by volume, is added and the materials are heated to 130° C. whereupon a solution of 2.5 parts t-butyl peroxybenzoate and 2.5 parts toluene added over 0.25 hour. The reaction is continued at 130° C. for 3 hours. Upon cooling, a significantly reduced amount (estimated 1–2 parts) of solids adhere to reactor wall. The materials are vacuum stripped for 0.5 hour at 150° C. and 20 mm Hg pressure. The residue is mixed with 800 parts mineral oil and the oil solution is collected as the product.

The hydrocarbyl group substituted carboxylic compositions of this invention are useful as additives for lubricating oil compositions and may be incorporated in a minor amount into a major amount of an oil of lubricating viscosity. They also serve as intermediates to undergo further reaction with amines, alcohols and metal-containing compounds to prepare derivative compositions which are useful as dispersant viscosity improvers for lubricants and fuels. The carboxylic derivative compositions are also incorporated in a minor amount into a major amount of an oil of lubricating viscosity. A major amount is defined herein as any amount greater than 50% by weight and a minor amount is any amount less than 50% by weight provided the total of all components is 100%.

Hydrocarbyl Group Substituted Carboxylic Derivative Compositions

The instant invention is also directed to derivatives of the hydrocarbyl substituted carboxylic compositions. These derivatives are hydrocarbyl group substituted carboxylic derivative compositions prepared by reacting at least one hydrocarbyl group substituted carboxylic composition of this invention with a reactant selected from the group consisting of (a) amines characterized by the presence within their structure of at least one condensable H—N< group, (b) alcohols, (c) reactive metal or reactive metal compounds, and (d) a combination of two or more of any of (a) through (c), the components of (d) being reacted with the carboxylic composition simultaneously or sequentially, in any order.

The hydrocarbyl group substituted carboxylic compositions are described in detail hereinabove.

Amines

The amines may be monoamines or polyamines, typically polyamines, preferably ethylene amines, amine bottoms or amine condensates. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated.

Monoamines useful in this invention generally contain from 1 to about 24 carbon atoms, preferably 1 to about 12, and more preferably 1 to about 6. Examples of primary monoamines useful in the present invention include methylamine, propylamine, butylamine, cyclopentylarnine, dodecylamine, allylamine, cocoamine and stearylamine. Examples of secondary monoamines include dimethylamine, dipropylamine, dicyclopentylamine, methylbutylamine, etc.

The monoamine may be an alkanol amine represented by at least one of the formulae:

$$H_2N—R'—OH,$$

and

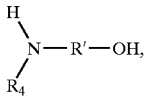

wherein each $R_4$ is independently a hydrocarbyl group of one to about 22 carbon atoms or hydroxyhydrocarbyl group of two to about 22 carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(bydroxyl lower alkyl)-morpholines, -thiomorpholines, -piperidines, oxazolidines, -thiazolidines and the like. Typically, however, each $R^4$ is independently a methyl, ethyl, propyl, butyl, pentyl or hexyl group.

Examples of alkanolamines include mono- and di-ethanolamine, ethylethanolamine, monomethylethanolamine, etc.

The hydroxylamines can also be ether N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

$$H_2N—(R'O)_x—H,$$

and

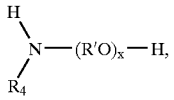

wherein x is a number from about 2 to about 15 and $R_4$ and R' are as described above. $R_4$ may also be a hydroxypoly (hydrocarbyloxy) group.

Other useful amines include ether amines of the general formula $$R_6OR^1NHR_7$$

wherein $R_6$ is a hydrocarbyl group, preferably an aliphatic group, more preferably an alkyl group, containing from 1 to about 24 carbon atoms, $R^1$ is a divalent hydrocarbyl group, preferably an alkylene group, containing from two to about 18 carbon atoms, more preferably two to about 4 carbon atoms and $R_7$ is H or hydrocarbyl, preferably H or aliphatic, more preferably H or alkyl, more preferably H. When $R_7$ is not H, then it preferably is alkyl containing from one to about 24 carbon atoms. Especially preferred ether amines are those available under the name SURFAM® produced and marketed by Sea Land Chemical Co., Westlake, Ohio.

The amine may also be a polyamine. The polyamine may be aliphatic, cycloaliphatic, heterocyclic or aromatic. Examples of useful polyamines include alkylene polyamines, hydroxy containing polyamines, polyoxyalkylene polyamines, arylpolyamines, and heterocyclic polyamines.

Alkylene polyamines are represented by the formula

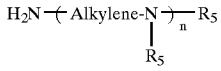

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently hydrogen, an aliphatic group or a hydroxy-substituted or amino-substituted aliphatic group of up to about 30 carbon atoms. Preferably $R_5$ is H or lower alkyl, most preferably, H.

Alkylene polyamines include methylene-, ethylene-, butylene-, propylene-, pentylene- and other polyamines. Higher homologs and related heterocyclic amines such as piperazines and N-amino alkyl-substituted piperazines are also included. Specific examples of such polyamines are ethylene diamine, diethylene triamine, triethylene tetramine, tris-(2-arinoethyl)amine, propylene diamine, N,N-dimethylaminopropylamine, trimethylene diamine, tripropylene tetramine, tetraethylene pentamine, hexaethylene heptamine, pentaethylenehexamine, aminoethyl piperazine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Tex., designated "E-100" has a specific gavity at 15.6° C. of 1.0168,% nitrogen of 33.15 and a viscosity at 40° C. of 121 centistokes. Gas chromatography analysis shows such a sample contains about 0.93% "light Ends" (most probably diethylenetriamine), 0.72% triethylenetetramine, 21.74% tetraethylenepentamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy alkyl compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl) amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

Polyamine reactants, which react with the polyhydric alcohol or amine to form the condensation products or condensed amines, are described above. Preferred polyamine. reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated by reference for its disclosure to the condensates and methods of making amine condensates.

The polyamines may be hydroxy-containing polyamines. These include hydroxy-containing polyamine analogs of hydroxy monoamines, particularly alkoxylated alkylenepolyamines. Such polyamines can be made by reacting the above-described alkylene amines with one or more of the above-described alkylene oxides.

Specific examples of alkoxylated alkylenepolyamines include N-(2-hydroxyethyl)ethylenediamine, N,N-di-(2-hydroxyethyl)-ethylenediamine, 1-(2-hydroxyethyl) piperazine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

The polyamines may be polyoxyalkylene polyamines, including polyoxyethylene and polyoxypropylene diamines and the polyoxypropylene triamines having average molecular weights ranging from about 200 to about 2000. Polyoxyalkylene polyamines, including polyoxyethylene-polyoxypropylene polyamines, are commercially available, for example under the tradename JEFFAMLNES® from Texaco Chemical Co. U.S. Pat. Nos. 3,804,763 and 3,948,800 contain disclosures of polyoxyalkylene polyamines and are incorporated herein by reference for their disclosure of such materials.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylthiomorpholines, N-aminoalkylmorpholines, N-aminoalkyl-piperazines, N,N'-bisaminoalkyl piperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoalkylsubstituted morpholines, pyrrolidine, and aminoalkylsubstituted pyrrolidines, are especially preferred. Usually the aminoalkyl substituents are substituted on a nitrogen atom forming part of the hetero ring. Specific examples of such heterocyclic amines include N-aminopropylmorpholine, N-amino-ethylpiperazine, and N,N'-diaminoethyl-piperazine. Hydroxy alkyl substituted heterocyclic polyamines are also useful. Examples include N-hydroxyethylpiperazine and the like.

Another useful amine is the condensation product of a hydrocarbyl, preferably aliphatic, containing from about 30 to about 200 carbon atoms, substituted mono- or polycarboxylic acid with at least one of the aforementioned polyamines in relative amounts such that the resulting condensation product contains at least one condensable N—H group. The condensation product may be pre-formed condensation or formed in situ. The pre-formed condensation product is preferred. Examples include polyisobutenyl ($\overline{M}_n$ ~1000) substituted succinic anhydride-ethylene polyamine and polypropylene ($\overline{M}_n$ ~800) substituted propionic acid-ethylene polyamine reaction products wherein each contains at least one condensable N—H group.

Hydrazine and substituted-hydrazine can also be used to form nitrogen-containing carboxylic dispersants. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy-substituted phenyl or lower alkyl-substituted phenyl. Specific examples of substituted hydrazines are methylhydrazine, N,N-dimethylhydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)-hydrazine, N-phenyl-N'-cyclohexylhydrazine, amino guanidine bicarbonate, and the like.

The carboxylic derivative compositions produced by reacting the hydrocarbyl group substituted carboxylic composition of the invention and the amines described above are acylated amines which include amine salts, amides; imides and imidazolines as well as mixtures thereof. To prepare the carboxylic derivative compositions from the amines, one or more of the hydrocarbyl group substituted carboxylic composition and one or more amines are heated, optionally in the presence of a normally liquid, substantially inert organic liquid solvent/diluent, at temperatures in the range of from about 80° C. up to the decomposition point of any of the reactants or the product, but normally at temperatures in the range of from about 100° C. up to about 300° C., provided 300° C. does not exceed the decomposition point. Temperatures of about 125° C. to about 250° C. are normally used. The carboxylic composition and the amine are reacted in an amount sufficient to provide from about one-half equivalent up to two moles of amine per equivalent of the carboxylic composition. In another embodiment, the carboxylic composition is reacted with from about one-half equivalent up to one mole of amine per equivalent of the carboxylic composition. For the purpose of this invention, an equivalent of amine is that amount of amine corresponding to the total weight of amine divided by the total number of nitrogens present having at least one H—N< group. Thus, octyl amine has an equivalent weight equal to its molecular weight; ethylenediamine has an equivalent weight equal to one-half its molecular weight, and aminoethylpiperazine, with 3 nitrogen atoms but only two having at least one H—N< group, has an equivalent weight equal to one-half of its molecular weight.

Alcohols

The carboxylic compositions may be reacted with (b) alcohols. Alcohols useful as (b) in preparing carboxylic derivative compositions of this invention from the hydrocarbyl group substituted carboxylic composition previously described include those compounds of the general formula $$R_3—(OH)_m$$

wherein $R_3$ is a monovalent or polyvalent organic radical joined to the —OH groups through carbon-to-oxygen bonds (that is,

—C—OH wherein the carbon is not part of a carbonyl group) and m is an integer of from 1 to about 10, usually 2 to about 6. As with the amine reactant (a), the alcohols can be aliphatic, cycloaliphatic, aromatic, and heterocyclic, including aliphatic-substituted cycloaliphatic alcohols, aliphatic-substituted aromatic alcohols, aliphatic-substituted heterocyclic alcohols, cycloaliphatic-substituted aliphatic alcohols, cycloaliphatic-substituted aromatic alcohols, cycloaliphatic-substituted heterocyclic alcohols, heterocyclic-substituted aliphatic alcohols, heterocyclic-substituted cycloaliphatic alcohols, and heterocyclic-substituted aromatic alcohols. Except for polyoxyalkylene alcohols, the mono- and polyhydric alcohols corresponding to the above formula will usually contain not more than about 40 carbon atoms and generally not more than about 20 carbon atoms. The alcohols may contain non-hydrocarbon substituents of the same type mentioned with respect to the amines above, that is, non-hydrocarbon substituents which do not interfere with the reaction of the alcohols with the acylating reagents of this invention. In general, polyhydric alcohols are preferred.

The monohydric and polyhydric alcohols useful as (b) include monohydroxy and polyhydroxy aromatic compounds. Monohydric and polyhydric phenols and naphthols are preferred hydroxyaromatic compounds. These hydroxy-substituted aromatic compounds may contain other substituents in addition to the hydroxy substituents such as halo, alkyl, alkenyl, alkoxy, alkyl-mercapto, nitro and the like. Usually, the hydroxy aromatic compound will contain 1 to 4 hydroxy groups. The aromatic hydroxy compounds are illustrated by the following specific examples: phenol, beta-naphthol, cresols, resorcinol, catechol, carvacrol, thymol, eugenol, p,p'-dihydroxybiphenyl, hydroquinone, pyrogallol, phloroglucinol, orcin, guaicol, 2,4-dibutylphenol, propenetetramer-substituted phenol, didodecylphenol, 4,4'-methylene-bis-methylene-bis-phenol, alpha-decyl-beta-naphthol, polyisobutenyl-(molecular weight of about 1000)-substituted phenol, the condensation product of heptylphenol with 0.5 mole of formaldehyde, the condensation product of octylphenol with acetone, di(hydroxyphenyl)oxide, di(hydroxyphenyl)sulfide, di(hydroxyphenyl)disulfide, and 4-cyclohexylphenol. Phenol itself and aliphatic hydrocarbon-substituted phenols, e.g., alkylated phenols having up to 3 aliphatic hydrocarbon substituents are especially preferred. Each of the aliphatic hydrocarbon substituents may contain 100 or more carbon atoms but usually will have from 1 to 20 carbon atoms. Alkyl and alkenyl groups are the preferred aliphatic hydrocarbon substituents.

Further specific examples of monohydric alcohols which can be used as (b) include monohydric alcohols such as methanol, ethanol, isooctanol, cyclohexanol, behenyl alcohol, neopentyl alcohol, isobutyl alcohol, benzyl alcohol, beta-phenethyl alcohol, 2,-methylcyclohexanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, sec-pentyl alcohol, tert-butyl alcohol, and dioleate of glycerol. Alcohols within (b) may be unsaturated alcohols such as allyl alcohol, cinnamyl alcohol, 1-cyclohexene-3-ol and oleyl alcohol.

Other specific examples of alcohols useful as (b) are the ether alcohols and amino alcohols including, for example, the oxyalkylene, oxy-arylene-, aminoalkylene-, and aminoarylene-substituted alcohols having one or more oxyallkylene, aminoalkylene or amino-aryleneoxy-arylene groups. They are exemplified by CELLOSOLVE®, CARBITOL®, phenoxyethanol, heptylphenyl-(oxypropylene)$_6$-OH, octyl-(oxyethylene)$_{30}$-OH phenyl-(oxyoctylene)$_2$—OH, mono-(heptylphenyl-oxypropylene)-substituted glycerol, poly(styrene oxide), aminoethanol, 3-amino-ethylpentanol, di(hydroxyethyl)amine, p-aminophenol, tri(hydroxypropyl)amine, N-hydroxyethyl ethylenediamine, N,N,N',N'-tetrahydroxy-trimethylenediamine, and the like. The polyhydric alcohols preferably contain from 2 to about 10 hydroxy groups. They are illustrated, for example, by the alkylene glycols and polyoxyalkylene glycols mentioned above such as ethylene glycol, triethylene glycol, tetraethylene glycol, dipropylene glycol, dibutylene glycol, and other alkylene glycols and polyoxyalkylene glycols in which the alkylene groups contain 2 to about 8 carbon atoms.

Other useful polyhydric alcohols include glycerol, monooleate of glycerol, monostearate of glycerol, monomethyl ether of glycerol, pentaerythritol, n-butyl ester of 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, celluloses, and so forth likewise can be used as (b). The carbohydrates may be exemplified by glucose, fructose, sucrose, rhamnose, mannose, glyceraldehyde, and galactose.

Polyhydric alcohols having at least 3 hydroxyl groups, some, but not all of which have been esterified with an aliphatic monocarboxylic acid having from about 8 to about 30 carbon atoms such as octanoic acid, oleic acid, stearic acid, linoleic acid, dodecanoic acid or tall oil acid are useful as (b). Further specific examples of such partially esterified polyhydric alcohols are the monooleate of sorbitol, distearate of sorbitol, monooleate of glycerol, monostearate of glycerol, di-dodecanoate of erythritol, and the like.

A preferred class of alcohols suitable as (b) are those polyhydric alcohols containing up to about 12 carbon atoms, and especially those containing 3 to 10 carbon atoms. This class of alcohols includes glycerol, erythritol, pentaerythritol, dipentaerythritol, gluconic acid, glyceraldehyde, glucose, arabinose, heptanediols, hexanetriols, butanetriols, guinic acid, 2,2,6,6-tetrakis-(hydroxymethyl)cyclohexanol, 1,10-decanediol, digitalose, and the like. Aliphatic alcohols containing at least three hydroxyl groups and up to 10 carbon atoms are particularly preferred.

An especially preferred class of polyhydric alcohols for use as (b) are the polyhydric alkanols containing 3 to 10 carbon atoms and particularly, those containing 3 to 6 carbon atoms and having at least three hydroxyl groups. Such alcohols are exemplified by glycerol, eiythritol, pentaerythritol, mannitol, sorbitol, 2-hydroxymethyl-2-methyl-1,3-propanediol(trimethylolethane), 2-hydroxy-methyl-2-ethyl-1,3-propanediol(trimethylpropane), 1,2, 4hexanetriol, and the like.

From what has been stated above, it is seen that (a) may contain alcoholic hydroxy substituents and (b) can contain primary, secondary, or tertiary amino substituents. Thus, amino alcohols can fall into both (a) and (b) provided they contain at least one primary or secondary amino group. If only tertiary amino groups are present, the amino alcohol belong only in (b).

Reactive Metals

Reactive metals or reactive metal compounds useful as (c) are those which will form carboxylic acid metal salts with the hydrocarbyl group substituted carboxylic composition of this invention and those which will form metal-containing complexes with the carboxylic derivative compositions produced by reacting the hydrocarbyl group substituted carboxylic composition with amines and/or alcohols as discussed above.

Reactive metal compounds useful for preparing metal salts of hydrocarbyl group substituted carboxylic composition of this invention include those salts containing metals selected from the group consisting of Group I metals, Group II metals, Al, Pb, Sn, Co and Ni. Examples of compounds include the oxides, hydroxides, alcoholates, and carbonates of Li, Na, K, Ca, Ba, Pb, Al, Sn, Ni and others. While reactive metals may also be employed, it is generally more convenient, and often more economical to employ the metal salts as reactants. An extensive listing of reactive metal compounds useful for preparing the metal salts of the hydrocarbyl group substituted carboxylic composition is provided in U.S. Pat. No. 3,271,310 (LeSuer) which is expressly incorporated herein by reference.

Reactive metal compounds useful as (c) for the formation of complexes with the reaction products of the acylating reagents of this invention and amines are disclosed in U.S. Pat. No. 3,306,908. Complex-forming metal reactants useful as (c) include the nitrates, nitrites, halides, carboxylates, phosphates, phosphites, sulfates, sulfites, carbonates, borates, and oxides of cadmium as well as metals having atomic numbers from 24 to 30 (including chromium, manganese, iron, cobalt, nickel, copper and zinc). These metals are the so-called transition or coordination metals, i.e., they are capable of forming complexes by means of their secondary or coordination valence. Specific examples of the complex-forming metal compounds useful as the reactant in this invention are cobalt, cobaltous oxide, cobaltous chloride, cobaltic chloride, chromotis acetate, chromic acetate, chromic sulfate, chromic hexanoate, manganous acetate, manganous benzoate, manganous nitrate, ferrous acetate, ferric benzoate, ferrous bromide, nickel nitrate, nickel dioleate, nickel stearate, copper (I) acetate, cupric benzoate, cupric formate, cupric nitrite; zinc benzoate, zinc borate, zinc chromate, cadmium benzoate, cadmium carbonate, cadmium butyrate. Hydrates of the above compounds are especially convenient for use in the process of this invention.

U.S. Pat. No. 3,306,908 is expressly incorporated herein by reference for its discussion of reactive metal compounds suitable for forming such complexes and its disclosure of processes for preparing the complexes. Basically, those processes are applicable to the carboxylic derivative compositions of the acylating reagents of this invention with the amines as described above by substituting, or on an equivalent basis, the acylating reagents of this invention with the high molecular weight carboxylic acid acylating agents disclosed in U.S. Pat. No. 3,306,908. The ratio of equivalents of the acylated amine thus produced and the complex-forming metal reactant remains the same as disclosed in U.S. Pat. No. 3,306,908.

The following examples illustrate carboxylic derivative compositions of this invention. Temperatures, pressures, and amounts are as set forth hereinabove.

EXAMPLE A

A reactor is charged with 2637 parts of the product of Example 1 (equivalent weights 65,000/C=C, 21,667/

C═O). The materials are heated to 150° C. under $N_2$ whereupon 9.7 parts polyamine bottoms E-100, Dow) are added dropwise over 0.5 hour. The materials are reacted for 2 hours at 150° C. then vacuum stripped to 150° C. at 20 mm Hg pressure. The residue is the product containing 0.134% N, total base number=2.82 and total acid number=0.35.

EXAMPLE B

A reactor is charged with 2200 parts of a 14 weigh % in mineral oil solution of an ethylene/propylene/dicyclopentadiene copolymer (weight ratio 63/36/1.5%) having $\overline{M}_w$ 150,000 and an average of about 12 C═C per molecule (Uniroyal Chemical) and 220 parts toluene. While stirring, 11 parts of the product of Example (B)-5 are added followed by heating to 130° C. under $N_2$. A solution of 8.8 parts each t-butyl peroxybenzoate and toluene is added over 0.75 hour. The materials are heated for 2 hours, then vacuum stripped to 150° C. at 20 mm Hg pressure. A portion of the residue is removed from the reactor leaving 2550 parts remaining. To this material are added 450 parts of a 50% in oil solution of the reaction product of polyisobutylene ($\overline{M}_n$ 1600) substituted succinic anhydride and polyethylene polyamine bottoms having total base number about 27, total acid number about 2 and containing about 1.16% N. The materials are heated to 150° C. under $N_2$, reacted at 150° C. for 3 hours then vacuum stripped to 150° C. at 20 mm Hg pressure. The residue is the product containing 0.169% N and having total acid number=1.34.

The Oil of Lubricating Viscosity

The lubricating compositions of this invention employ an oil of lubricating viscosity, including natural or synthetic lubricating oils and mixtures thereof.

Natural oils include animal oils and vegetable oils (e.g. castor oil, lard oil) as well as mineral lubricating oils such as liquid petroleum oils and solvent-treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and the derivatives, analogs and homologues thereof and the like.

Alkylene oxide polymers and interpolymers and derivatives thereof where their terminal hydroxyl groups have been modified by esterification, etherification, etc., constitute another useful class of known synthetic lubricating oils.

Another suitable class of synthetic lubricating oils that can be used comprises the esters of di- and polycarboxylic acids and those made from $C_5$ to $C_{20}$ monocarboxylic acids and polyols and polyolethers.

Other synthetic lubricating oils include liquid esters of phosphorus-containing acids, polymeric tetrahydrofurans and the like, silicon-based oils such as the polyalkyl-, polyaryl-, polyalkoxy-, or polyaryloxy-siloxane oils and silicate oils.

Unrefined, refined and redefined oils, either natural or synthetic (as well as mixtures of two or more of any of these) of the type disclosed hereinabove can be used in the compositions of the present invention. Unrefined oils are those obtained directly from natural or synthetic sources without further purification treatment. Refined oils are similar to the unrefined oils except they have been further treated in one or more purification steps to improve one or more properties. Refined oils include solvent refined oils, hydrorefined oils, hydrofinished oils, hydrotreated oils, and oils obtained by hydrocracking and hydroisomerization techniques.

Redefined oils are obtained by processes similar to those used to obtain refined oils applied to refined oils which have been already used in service. Such redefined oils often are additionally processed by techniques directed to removal of spent additives and oil breakdown products.

Specific examples of the above-described oils of lubricating viscosity are given in Chamberlin, III, U.S. Pat. No. 4,326,972, European Patent Publication 107,282, and A. Sequeria, Jr., Lubricant Base Oil and Wax Processing, Chapter 6, Marcel Decker, Inc., New York (1994), each of which is hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated herein by reference for relevant disclosures contained therein.

The Normally Liquid Fuels

As indicated hereinabove, the products of this invention may also be used as additives for normally liquid fuels.

The fuels used in the fuel compositions of this invention are well known to those skilled in the art and usually contain a major portion of a normally liquid fuel such as hydrocarbonaceous petroleum distillate fuel (e.g., motor gasoline as defined by ASTM Specifications D439-89 and D4814-91 and diesel fuel or fuel oil as defined in ASTM Specifications D-396-90 and D-975-91). Fuels containing non-hydrocarbonaceous materials such as alcohols, ether, organo-nitro compounds and the like, are also within the scope of this invention as are liquid fuels derived from vegetable or mineral sources. A range of alcohol and ether type compounds are described as oxygenates. Oxygenate-containing fuels are described in ASTM D4814-91. Mixtures of any of the above-described fuels are useful.

Particularly preferred fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel compositions typically contain from about 0.001% to about 2% by weight, more often up to about 0.5%, even more often up to about 0.2% by weight of the additives of this invention.

The fuel compositions of the present invention may contain other additives which are well known to those skilled in the art. These can include anti-knock agents such as tetra-alkyl lead compounds, lead scavengers such as halo-alkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizers, metal deactivators, demulsifiers, anti-icing agents and the like. The fuel compositions of this invention may be lead-containing or lead-free fuels. Preferred are lead-free fuels.

Other Additives

As mentioned, lubricating oil compositions of this invention may contain other components. The use of such additives is optional and the presence thereof in the compositions of this invention will depend on the particular use and level of performance required. Thus the other additive may be included or excluded. The compositions may comprise a zinc salt of a dithiophosphoric acid. Zinc salts of dithiophosphoric acids are often referred to as zinc dithiophosphates, zinc O,O'-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed hereinabove, other additives that may optionally be used in the lubricating oils of this invention include, for example, auxiliary detergents and dispersants, viscosity improvers, oxidation inhibiting agents, pour point depressing agents, extreme pressure agents, anti-wear agents, color stabilizers and anti-foam agents. The above-mentioned dispersants and viscosity improvers may be used in addition to the compositions of this invention.

Auxiliary extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, molybdenum compounds, and the like.

Auxiliary viscosity improvers (also sometimes referred to as viscosity index improvers or viscosity modifiers) may be included in the compositions of this invention. Viscosity improvers are usually polymers, including polyisobutenes, polymethacrylic acid esters, diene polymers, polyalkyl styrenes, esterified styrene-maleic anhydride copolymers, alkenylarene-conjugated diene copolymers and polyolefins. Multifunctional Viscosity improvers, other than those of the present invention, which also have dispersant and/or anti-oxidancy properties are known and may optionally be used in addition to the products of this invention. Such products are described in numerous publications including those mentioned in the Background of the Invention. Each of these publications is hereby expressly incorporated by reference.

Pour point depressants are often included in the lubricating oils described herein. See for example, page 8 of 'Lubricant Additives" by C. V. Smalheer and R. Kennedy Smith (Lezius-Hiles Company Publisher, Cleveland, Ohio, 1967). Pour point depressants, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kemer (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by a least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Many types are known in the art, and are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent number 1,306,529 and in many U.S. patents including the following:

| |
|---|
| 3,163,603 |
| 3,184,474 |
| 3,215,707 |
| 3,219,666 |
| 3,271,310 |
| 3,272,746 |
| 3,281,357 |
| 3,306,908 |
| 3,311,558 |
| 3,316,177 |
| 3,340,281 |
| 3,341,542 |
| 3,346,493 |
| 3,351,552 |
| 3,381,022 |
| 3,399,141 |
| 3,415,750 |
| 3,433,744 |
| 3,444,170 |
| 3,448,048 |
| 3,448,049 |
| 3,451,933 |
| 3,454,607 |
| 3,467,668 |
| 3,501,405 |
| 3,522,179 |
| 3,541,012 |
| 3,541,678 |
| 3,542,680 |
| 3,567,637 |
| 3,574,101 |
| 3,576,743 |
| 3,630,904 |
| 3,632,510 |
| 3,632,511 |
| 3,697,428 |
| 3,725,441 |
| 4,194,886 |
| 4,234,435 |
| 4,491,527 |
| 5,696;060 |
| 5,696,067 |
| RE26,433 |

(2) Reaction products of relatively high molecular weight aliphatic or alicyclic halides with amines, preferably polyalkylene polyamines. These may be characterized as "amine dispersants" and examples thereof are described for example, in the following U.S. patents:

| |
|---|
| 3,275,554 |
| 3,438,757 |
| 3,454,555 |
| 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U. S. patents are illustrative:

| |
|---|
| 3,413,347 |
| 3,697,574 |
| 3,725,277 |
| 3,725,480 |
| 3,726,882 |

(4) Products obtained by post-treating the carboxylic amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like Exemplary materials of this kind are described in the following U.S. patents:

| |
|---|
| 3,036,003 |
| 3,087,936 |
| 3,200,107 |
| 3,216,936 |
| 3,254,025 |
| 3,256,185 |
| 3,278,550 |
| 3,280,234 |
| 3,281,428 |
| 3,282,955 |
| 3,312,619 |
| 3,366,569 |
| 3,367,943 |
| 3,373,111 |
| 3,403,102 |
| 3,442,808 |
| 3,455,831 |
| 3,455,832 |
| 3,493,520 |
| 3,502,677 |
| 3,513,093 |
| 3,533,945 |
| 3,539,633 |
| 3,573,010 |
| 3,579,450 |
| 3,591,598 |
| 3,600,372 |
| 3,639,242 |
| 3,649,229 |
| 3,649,659 |
| 3,658,836 |
| 3,697,574 |
| 3,702,757 |
| 3,703,536 |
| 3,704,308 |
| 3,708,522 |
| 4,234,435 |

(5) Polymers and copolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| |
|---|
| 3,329,658 |
| 3,449,250 |
| 3,519,565 |
| 3,666,730 |
| 3,687,849 |
| 3,702,300 |

The above-noted patents are incorporated by reference herein for their disclosures of ashless dispersants.

The above-illustrated additives may each be present in lubricating compositions at a concentration of as little as 0.001% by weight, usually ranging from about 0.01% to about 20% by weight. In most instances, they each contribute from about 0.1% to about 10% by weight, more often up to about 5% by weight.

Additive Concentrates

The various compositions and other additives described herein can be added directly to the lubricant. Preferably, however, they are diluted with a substantially inert, normally liquid organic diluent such as mineral oil, naphtha, benzene, toluene or xylene, to form an additive concentrate. Preferred additive concentrates contain the diluents referred to hereinabove. These concentrates usually comprise about 0.1 to about 80% by weight of the compositions of this invention and may contain, in addition, one or more other additives Known in the art or described hereinabove. Concentrations such as 15%, 20%, 30% or 50% or higher may be employed.

Lubricating Oil Compositions

The instant invention also relates to lubricating oil compositions containing the carboxylic compositions of the invention. As noted hereinabove, the carboxylic compositions of this invention may be blended directly into an oil or lubricating viscosity or, more often, are incorporated into an additive concentrate containing one or more other additives which in turn is blended into the oil.

Lubricant Examples AA–BB

SAE 15W-40 lubricating oil compositions are prepared by blending 0.1 part of a 40% in oil solution of a styrene-maleate copolymer neutralized with aminopropylmorpholine; 6.5 parts of an additive concentrate prepared by combining 55.385 parts of a 50% in oil solution of a polyisobutylene ($\overline{M}_n$ 1600) substituted succinic anhydride-ethylene polyamine reaction product, 8.05 parts of Zn mixed isopropyl-methyl amyl phosphorodithioate, 3.65 parts sulfurized butadiene-butyl acrylate Diels-Alder adduct, .0.23 parts 2,5-bis(t-nonyldithio)-1,3,4-thiadiazole (Amoco 158 Amoco), 6.58 parts Ca overbased (MR 2.3) sulfurized alkyl phenol, 5.35 parts calcium overbased (MR 11) alkyl benzene sulfonic acid, 3.67 parts calcium overbased (MR 2.8) alkyl benzene sulfonic acid, 0.07 parts of a kerosene solution of a commercial silicone antifoam and sufficient mineral oil to bring the total weight of the additive concentrate to 100 parts; and the indicated amounts of the product of the listed Example, in sufficient mineral oil (Exxon stocks) to prepare 100 parts of lubricant:

| | Lubricant | |
|---|---|---|
| | AA | BB |
| Product of Example: (pbw) | A (8.0) | B (9.4) |

Lubricant Examples CC and DD

SAE 15W-40 lubricating oil compositions are prepared by blending 0.1 part of a 40% in oil solution of a styrene-maleate copolymer neutralized with aminopropylmorpholine; 13 parts of the additive concentrate described in Example AA and BB; and the indicated amounts of the product of the listed Example, in sufficient mineral oil (Exxon stocks) to prepare 100 parts of lubricant:

| | Lubricant | |
|---|---|---|
| | CC | DD |
| Product of Example: (pbw) | A (8.0) | B (9.4) |

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A hydrocarbyl group substituted carboxylic composition derived from (A) a hydrocarbon polymer having $\overline{M}_n$ ranging from about 20,000 to about 500,000 and (B) an α,β-unsaturated carboxylic compound prepared by reacting (1) an active methylene compound of the formula

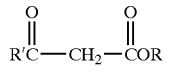

and (2) a carbonyl compound of the general formula

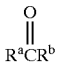

wherein $R^a$ is H or hydrocarbyl and $R^b$ is

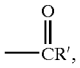

wherein each R' is independently R or OR and each R is, independently, H or a hydrocarbyl group; and lower alkyl acetals, ketals, hemiacetals and hemiketals of the carbonyl compound (2).

2. The carboxylic composition of claim 1 wherein the hydrocarbon polymer comprises an ethylene-$C_{3-28}$ olefin copolymer.

3. The carboxylic composition of claim 1 wherein the active methylene compound comprises a di-lower alkyl malonate or a lower alkyl acetoacetate.

4. The carboxylic composition of claim 1 wherein the carbonyl compound (2) is a compound having the general formula

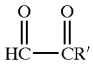

or a reactive equivalent thereof.

5. The carboxylic composition of claim 4 wherein the carbonyl compound is glyoxylic acid or a reactive equivalent thereof.

6. A hydrocarbyl group substituted polycarboxylic composition derived from (A) a hydrocarbon polymer having $\overline{M}_n$ ranging from about 20,000 to about 500,000 and (B) an α,β-unsaturated polycarboxylic compound of the general formula

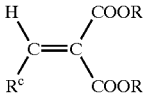

wherein $R^c$ is

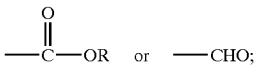

and each R is, independently, H or hydrocarbyl.

7. A process for preparing a hydrocarbyl group substituted carboxylic composition comprising reacting (A) a hydrocarbon polymer having $\overline{M}_n$ ranging from about 20,000 to about 500,000 and, (B) an α,β-unsaturated carboxylic compound prepared by reacting (1) an active methylene compound of the formula

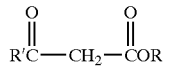

and (2) a carbonyl compound of the general formula

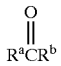

wherein $R^a$ is H or hydrocarbyl and $R^b$ is

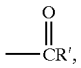

wherein each R' is independently R or OR and each R is, independently, H or a hydrocarbyl group; and lower alkyl acetals, ketals, hemiacetals and hemiketals of the carbonyl compound (2).

8. The process of claim 7 wherein said reacting of (A) the hydrocarbon polymer and (B) the α,β-unsaturated carboxylic compound is conducted thermally at temperatures ranging from about 80° C. to about 220° C.

9. The process of claim 7 wherein said reacting of is conducted with the addition of from about 0.1 to about 2.5 moles $Cl_2$ per mole of (B) polycarboxylic compound.

10. A lubricating oil composition comprising a major amount of an oil of lubricating viscosity and a minor amount of the hydrocarbyl group substituted carboxylic composition of claim 1.

11. A hydrocarbyl group substituted carboxylic derivative composition prepared by reacting at least one hydrocarbyl group substituted carboxylic composition according to claim 1 with a reactant selected from the group consisting of (a) amines characterized by the presence within their structure of at least one condensable H—N< group, (b) alcohols, (c) reactive metal or reactive metal compounds, and (d) a combination of two or more of any of (a) through (c), the components of (d) being reacted with the carboxylic composition simultaneously or sequentially, in any order.

12. A process for preparing a hydrocarbyl group substituted carboxylic derivative composition comprising reacting the hydrocarbyl substituted carboxylic composition prepared by reacting (A) a hydrocarbon polymer having $\overline{M}_n$ ranging from about 20,000 to about 500,000 and, (B) an α,β-unsaturated carboxylic compound prepared by reacting (1) an active methylene compound of the formula

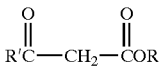

and (2) a carbonyl compound of the general formula

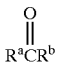

wherein $R^a$ is H or hydrocarbyl and $R^b$ is

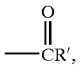

wherein each R' is independently R or OR and each R is, independently, H or a hydrocarbyl group; and lower alkyl acetals, ketals, hemiacetals and hemiketals of the carbonyl compound (2) with a reactant selected from the group consisting of (a) amines characterized by the presence within their structure of at least one condensable H—N< group, (b) alcohols, (c) reactive metal or reactive metal compounds, and (d) a combination of two or more of any of (a) through (c), the components of (d) being reacted with the carboxylic composition simultaneously or sequentially, in any order.

13. An additive concentrate for preparing lubricating oil and fuel compositions comprising from about 20% to about 99% by weight of a normally liquid, substantially inert organic diluent and from about 1% to about 80% by weight of at least one carboxylic composition of claim 1.

* * * * *